United States Patent [19]

Fell et al.

[11] Patent Number: 4,461,402

[45] Date of Patent: Jul. 24, 1984

[54] CONTAINER LINER

[75] Inventors: Donald R. Fell, Stoney Creek; Seiji Takeuchi, Burlington, both of Canada

[73] Assignees: Don Fell Limited; Lawrence Fell Limited, both of Hamilton, Canada

[21] Appl. No.: 481,170

[22] Filed: Apr. 1, 1983

[51] Int. Cl.[3] ..... B65D 33/02; B65D 33/14; B65D 33/38; B65D 90/04

[52] U.S. Cl. ..... 222/105; 105/423; 220/85 B; 220/403; 220/461; 222/183; 296/39 R; 383/103; 383/119

[58] Field of Search ..... 220/403, 460, 461, DIG. 24, 220/372, 85 B; 222/105, 183; 296/39 R; 105/423; 137/855, 582; 141/68, 10, 350, 154, 114, 313–317; 383/103, 119

[56] References Cited

U.S. PATENT DOCUMENTS

| | | | |
|---|---|---|---|
| Re. 29,721 | 8/1978 | Ukmar et al. | 220/403 X |
| 218,113 | 8/1879 | Chappell | 206/524.5 X |
| 593,674 | 11/1897 | Mather | 296/39 R |
| 1,568,176 | 1/1926 | Mohan | 220/372 |
| 2,379,126 | 6/1945 | Welden | 220/460 X |
| 2,394,607 | 2/1946 | Gray et al. | 220/461 X |
| 2,693,000 | 11/1954 | Minerley | 137/582 X |
| 2,777,397 | 1/1957 | Atkinson | 137/855 X |
| 2,884,978 | 5/1959 | Grimm | 220/85 B X |
| 2,994,452 | 8/1961 | Morrison | 114/74 A X |
| 3,016,938 | 1/1962 | Akrep | 220/85 B |
| 3,144,953 | 8/1964 | Taylor | 220/85 B X |
| 3,156,489 | 11/1964 | Deringer | 285/DIG. 20 |
| 3,460,168 | 8/1969 | DeBruyne | 137/855 |
| 3,578,213 | 5/1971 | Clark et al. | 222/183 X |
| 3,699,912 | 10/1972 | Wilson, Jr. | 220/85 B X |
| 3,951,284 | 4/1976 | Fell et al. | 296/39 R X |
| 4,054,226 | 10/1977 | Bjelland et al. | 220/461 X |
| 4,101,045 | 7/1978 | Roberts et al. | 220/461 X |

FOREIGN PATENT DOCUMENTS

| | | | |
|---|---|---|---|
| 579845 | 7/1959 | Canada | 105/423 |
| 995603 | 8/1976 | Canada . | |
| 594452 | 6/1959 | Italy | 220/85 B |
| 1302830 | 1/1973 | United Kingdom . | |
| 1304688 | 1/1973 | United Kingdom . | |
| 1580807 | 12/1980 | United Kingdom . | |
| 2072618 | 10/1981 | United Kingdom . | |

*Primary Examiner*—Allan N. Shoap

[57] ABSTRACT

The present invention relates to a disposable liner comprised of a thin sheet plastics material formed into a long tube having left and right sides and a top and bottom. The tube is closed at each end by end panels formed by folded end flaps of the tube. One end panel has located therein an inlet port and an outlet port formed of reinforced plastics sheet material in the form of tubes attached to the panel. Each port surrounds an aperture in the panel. Upper hook fasteners are located at least at the left and right top corners of the liner at both ends thereof and a lower fastener is located along the bottom edge of the liner at one end thereof. The interior surface of the end panel of the liner opposite the inlet port is protected with a flap made of reinforced plastics material.

11 Claims, 7 Drawing Figures

CONTAINER LINER

The present invention relates to disposable liners for use with rigid containers, as for example, the box structure of a truck vehicle, a seagoing vessel or other container.

In particular, the liner according to the present invention is adapted to be pneumatically filled with a flowable material. It is contemplated that such a liner would be used once and then discarded. As a result, it is necessary to provide a liner which is strong and free of rupture but which is inexpensive and simple to use.

In accordance with the present invention there is provided a disposable liner for use with a rigid container adapted to be pneumatically filled with a flowable material, said liner comprising: a tube of thin sheet plastics material forming left and right side panels and top and bottom panels; front and back end panels being formed by folding and joining end flaps of said tube to provide top, bottom and side edges at the junction of said top and bottom and left and right side panels with said front and back end panels; inlet and outlet ports located in said back end panel, said ports being comprised of tubes of reinforced plastics sheet material, each attached at one end to said back end panel around an aperture located therein; hook attachment means located at least at top corners of said liner adjacent the top edge formed by said front and back end panels; bottom attachment means located along the bottom edge formed by said front end panel; and a reinforcing flap element protecting the inner surface of said front end panel, said flap element being attached to said liner along the top edge formed by said front end panel.

The present invention will be described in detail hereinbelow with the aid of the accompanying drawings in which.

Figure 3:
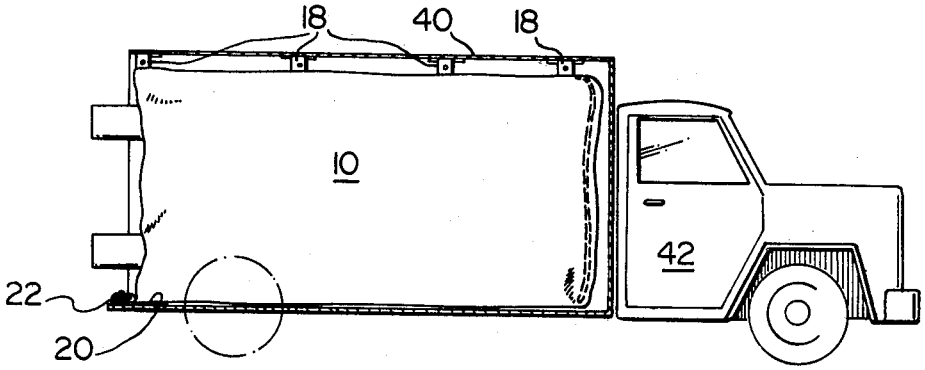
FIG. 3 is a schematic representation, partially broken-away, of a liner located within a truck.
Figure 2:
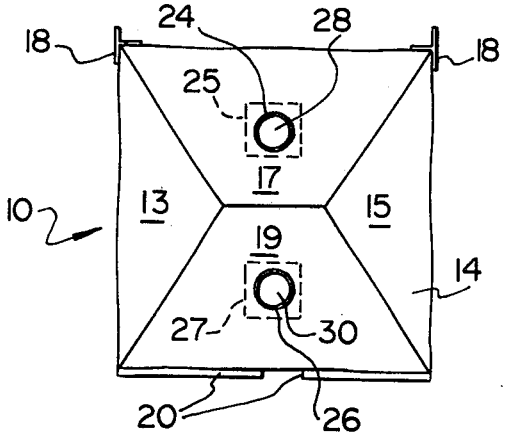
FIG. 2 is an end view of the liner of FIG. 1.
Figure 5:
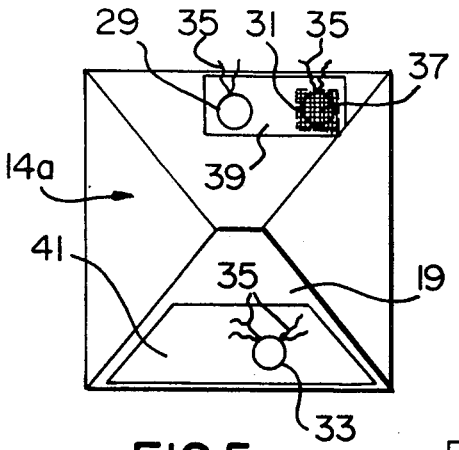
FIGS. 4 to 7 show alternative features.
Figure 4:
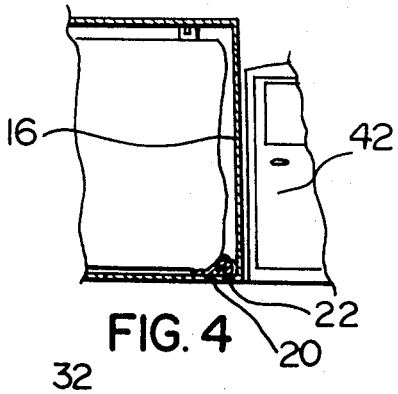
Figure 6:
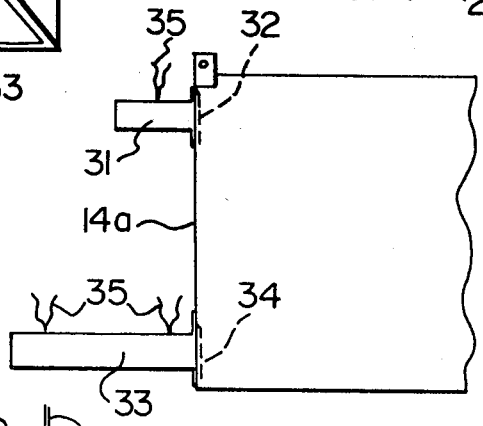

FIG. 4 being a modified portion of FIG. 3;

FIG. 5 being a modified version of the liner seen in end view corresponding to FIG. 2;

FIG. 6 being a partial side elevation of the FIG. 5 modification; and

Figure 7:
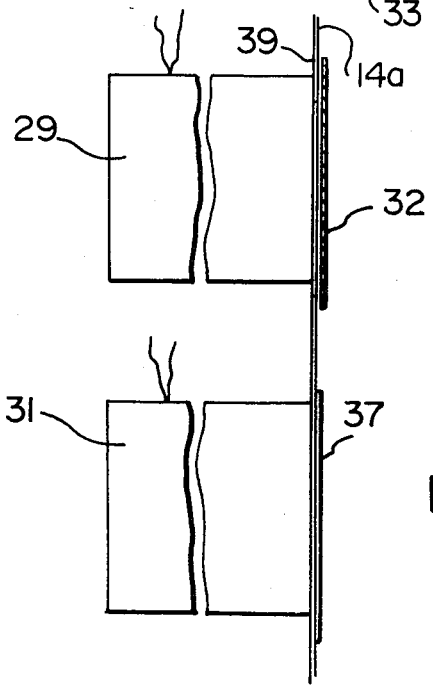

FIG. 7 being a plan view of FIG. 5 with the top panel cut away.

Figure 1:
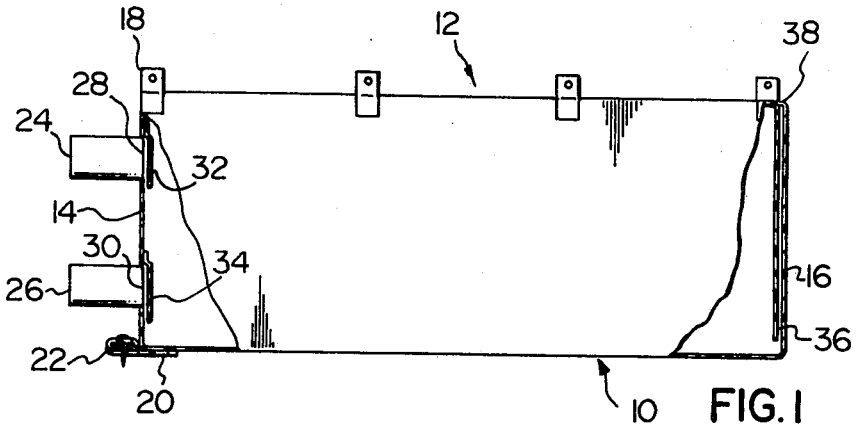
FIG. 1 is a partially broken-away side elevation of a liner according to the present invention.

Referring now to FIGS. 1 and 2, a liner 10 is comprised of an elongated tube portion 12 made of a thin plastics material, for example, polyethylene. The polyethylene is typically 6 mils thick. One example of an acceptable material is "Felcofilm" (trade mark).

The longitudinal portion of the liner is made from a tube of polyethylene and therefore contains no joints. Flaps 13, 15, 17 and 19 are formed in the end portions of the tube 12. The left-most set of flaps are shown in FIG. 2. An identical set of flaps is present on the right side of tube 12 as seen in FIG. 1. These flaps are heat-sealed together to form front and back end panels 14 and 16. Hook fasteners 18 are provided along the top edges of the tube portion 12. Each hook fastener is made from a reinforced woven plastics material and is heat-sealed to the tube 12. Each hook fastener has an aperture located therethrough for connection to hooks located on a rigid structure which holds the liner. Some embodiments of the liner according to the present invention contain only two hook fasteners located on each side of the tube 12 at the top directly adjacent the back end panel 14.

A nailing strip 20 is heat-sealed along the lower edge of the tube 12 directly adjacent the back end panel 14. This nailing strip consists of a strip of plastics material heat-sealed to the liner and formed into a loop which contains a wooden slat 22. This wooden slat 22 can be nailed to the bottom of the rigid container for securing the liner within the container.

Apertures 28 and 30 are formed in back end panel 14. Inlet and outlet ports are made by heat-sealing tubes 24 and 26 to flanges 25 and 27 (see FIG. 2). Flanges 25 and 27 are then heat-sealed around apertures 28 and 30, respectively, to the back end panel 14. Inlet and outlet ports 24 and 26 and flanges 25 and 27 are made from a woven reinforced plastics material. One embodiment of the present invention contains flaps 32 and 34 made of woven reinforced plastics material heat-sealed to the inner surface of the back end panel 14 over the apertures 28 and 30. These flaps are moved out of the way during the filling of the liner by virtue of the pneumatic pressure. However, when no pressure is exerted, the flaps cover the holes 28 and 30 and reduce contamination of the product contained within the filled liner. When the liner 10 is emptied the lower flap 34 is merely cut to allow an exit of the material from outlet port 26.

It was found that during filling, the flowable material entering port 24 could be blown directly to the front of the liner 10 to impinge upon the front end panel 16. If the material filling the liner is abrasive, its contact with the front panel 16 causes failure of that panel. As a result, a protective flap 36 is installed at the front end portion of the liner. The flap 36 rests against front end panel 16 and is heat-sealed along the top edge of tube 12 at 38. The protective flap is made of a reinforced woven plastics material.

FIG. 3 shows the liner 10 installed in a rigid container, for example, the box 40 of a truck 42. The liner 10 is designed to completely fill the box and is therefore supported on its bottom, sides and end by the box 40. Hook fasteners 18 initially hold the liner within the container 40. Nailing strip holder 20 containing a wooden slat 22 secures the back lower portion of the liner to the rigid container 40. It should be noted that these fasteners are primarily used during the initial stages of filling. The liner is secured to the rigid container primarily by virtue of the flowable material contained within the liner.

FIG. 4 shows the location of the nailing strip 20 and slat 22 at the front end 16, instead of at the back end panel 14.

FIGS. 5 to 7 show a modified back end panel **14*a* containing a loading tube 29, a vent tube 31 and a discharge tube 33 fitted with ties 35 for closing them off. The discharge tube 33 is about twice as long as the loading tube to facilitate attachment to an unloading device. The discharge tube 33 is offset from the centre line, as seen in FIG. 5, to enable discharge to take place while one of the rear doors of the box of the truck (in this case the lefthand door) is closed to provide added support for the bulkheads that will hold the liner in place. Inside the liner behind the vent tube 31 there is a sheet of netting 37 secured across the orifice. Tubes 29 and 33 have flaps 32 and 34 as before. The vent tube 31** has no flap.

Reinforcing flanges 39 and 41 are similar to the flanges 25, 27 in that they are made of a woven reinforced plastics material. However the flanges 39 and 41 are located on the outside surface of the back end panel 14*a* in order to protect such panel against abrasion by the bulkheads and doors (not shown) at the rear of the truck 42. The flange 39 is rectangular and extends between and slightly beyond the tubes 29 and 31. The flange 41 is trapezoidal, conforming its shape comparatively closely to the lower flap 19 of the panel 14*a*.

We claim:

1. A disposable liner for use with a rigid container adapted to be pneumatically filled with a flowable material, said liner comprising:

(a) a tube of thin sheet plastics material forming left and right side panels and top and bottom panels;

(b) vertically extending front and back end panels being formed by folding and joining end flaps of said tube to provide top, bottom and side edges at the junction of said top and bottom and left and right side panels with said front and back end panels;

(c) inlet and outlet ports located in said back end panel, said ports being comprised of tubes of reinforced plastics sheet material, each attached at one end to said back end panel around an aperture located therein;

(d) hook attachment means located at least at top corners of said liner adjacent the top edge formed by said front and rear end panels;

(e) bottom attachment means located along a bottom edge formed by an end panel; and (f) a protective flap element of reinforced plastics material for protecting the inner surface of said front end panel, said flap element being attached to said liner along the top edge formed by said front end panel to hang adjacent the front end panel and being located opposite said inlet port in the back end panel whereby to protect the front end panel from abrasion when the liner is filled with abrasive flowable material projected pneumatically into the liner through said inlet port towards said front end panel.

2. The liner according to claim 1, wherein protective flaps hang freely adjacent the back end panel to cover both the inlet and outlet ports.

3. The liner according to claim 2, wherein the protective flaps covering the inlet and outlet ports and the flap element are made of a woven reinforced plastics material.

4. The liner according to claim 1, wherein said plastics material is polyethylene having a thickness of about 6 mils.

5. The liner according to claim 1, wherein said bottom attachment means is comprised of a nailing strip holder heat-sealed to said liner and forming a pocket containing a wooden slat for nailing to said rigid container.

6. The liner according to claim 1, wherein the bottom attachment means is located along the bottom edge formed by the back end panel.

7. The liner according to claim 1, wherein the bottom attachment means is located along the bottom edge formed by the front end panel.

8. The liner according to claim 1, including a vent port comprised of a tube of reinforced plastics sheet material attached at one end to the back end panel around an aperture located therein, and a sheet of netting extending across said aperture.

9. The liner according to claim 1, including reinforcing flanges surrounding the tubes and located on the outer surface of the back end panel to protect said panel against abrasion by a bulkhead or door provided on the container.

10. The liner according to claim 1, wherein the tube constituting the outlet port is longer than the tube constituting the inlet port.

11. The liner according to claim 1, wherein the outlet port is located offset from the centreline of the back end panel to enable discharge from said outlet port to take place while a door is closed across a half of the rear of the container.

* * * * *